US005205723A

United States Patent [19]

Kawai et al.

[11] Patent Number: 5,205,723

[45] Date of Patent: Apr. 27, 1993

[54] HERMETICALLY SEALED COMPRESSOR

[75] Inventors: Hideki Kawai; Satoshi Wada, both of Fujisawa; Masahiko Osaka, Chigasaki, all of Japan

[73] Assignee: Matsushita Refrigeration Company, Osaka, Japan

[21] Appl. No.: 751,128

[22] Filed: Aug. 28, 1991

[30] Foreign Application Priority Data

Jan. 22, 1991 [JP] Japan ..... 3-5593
Jan. 22, 1991 [JP] Japan ..... 3-5594
Apr. 3, 1991 [JP] Japan ..... 3-70923

[51] Int. Cl.[5] ..... F04B 35/04
[52] U.S. Cl. ..... 417/415
[58] Field of Search ..... 417/415; 384/255; 74/44, 570

[56] References Cited

U.S. PATENT DOCUMENTS 4,248,050 2/1981 Durenec ..... 417/415
4,834,627 5/1989 Gannaway ..... 417/415
5,033,941 7/1991 Jensen ..... 417/415

*Primary Examiner*—Richard A. Bertsch
*Assistant Examiner*—Alfred Basichas
*Attorney, Agent, or Firm*—Ratner & Prestia

[57] ABSTRACT

A hermetically sealed compressor for use in household appliances such as refrigerators comprising an electric element and a compression element being resiliently supported within a hermetic container. The crankshaft is secured to a rotor of an electric element and supported by a pair of ball bearings. The crankshaft is comprised of a concentric principal part, a concentric secondary part and an eccentric axial part positioned between the principal part and the secondary part. The eccentric axial part is connected to one end of a connecting rod. In one embodiment, the eccentric axial part overlays all of the principal part and secondary part when seen in plan or projection view from the axial direction of the crankshaft. One of a pair of ball bearings is installed in each of the concentric principal part and secondary part respectively so as to support the load caused by the reaction of the compression load equally on each side of the axis along which the force of that load is exerted.

6 Claims, 3 Drawing Sheets

HERMETICALLY SEALED COMPRESSOR

BACKGROUND OF THE INVENTION

1. Field of the Invention

This invention relates generally to hermetically sealed compressors, and more particularly to small hermetically sealed refrigeration compressors, used in household appliances such as refrigerators and food freezers.

2. Description of Prior Art

Because of high energy costs and various governmental requirements, household appliances are being extensively redesigned to increase their energy efficiency. In the case of refrigerators, substantial improvements have been made by various improvements of the refrigeration system itself, including improvements in the size of evaporators and condensers. One of the objectives that has received the most attention is to increase the efficiency of refrigeration compressors. Increases in compressor efficiency have come primarily from increases in the electrical efficiency of motors which drive the compressors and from increases in pump volumetric efficiency. Decreasing the bearing friction of a principal rotating part, such as a crankshaft, in such compressors, will also contribute to increasing the efficiency of a refrigeration compressor.

A conventional hermetically sealed compressor of the type referred to above, for use in household appliances such as refrigerators, is described here with reference to FIG. 7 (as also disclosed in Japanese Laid-open Patent Applications No. 63-5186). In FIG. 7, electric element 1 and compression element 2 are generally resiliently supported within and in spaced relationship to hermetic container 3. Electric element 1 comprises stator 4, rotor 5, and crankshaft 6. Rotor 5 is pressed in place on crankshaft 6. Ball bearings 7, 8 are securely positioned at both upper and lower ends of bearing hub 9 to support the weight of rotor 5 and crankshaft 6. At its lower end, crankshaft 6 carries an eccentric axial part 10, which is integrally formed in a single molding with crankshaft 6. Eccentric axial element 10 fits within one end of connecting rod 11 and the other end of connecting rod 11 is connected to piston 12 which is slidably positioned within cylinder 13. In the above-described structure, in operation, the compressor is driven by stator 4 and rotor 5 powered by connection with a source of electrical energy (not shown) and piston 12 is reciprocated in cylinder 13 to compress refrigerant gasses.

However, this conventional hermetically sealed compressor may have some collateral disadvantages which include:

(a) Because of a cantilever structure, that is, both ball bearings 7 and 8 are installed at the same side in regard to the axis of cylinder 13, ball bearings 7 and 8 are heavily loaded in operation. FIG. 8 shows a schematic force diagram of ball bearings 7, 8 as they are loaded in operation. W is a reaction force to the compression action. L is the distance between ball bearing 8 and axis 13A of cylinder 13. K is the distance between ball bearings 7 and 8. J is the distance between bearing 7 and axis 13A of cylinder 13. As shown in FIG. 8, ball bearing 7 is pressed by the force of W·L/K which is larger than W in the direction shown by arrow A. Ball bearing 8 is also heavily pressed by the force of W·J/K in the direction shown by arrow B. Accordingly, the above-described structure may cause a reduction in the life span of both ball bearings 7 and 8, and it may be very difficult to assure the reliability of such a structure.

(b) In general, it is necessary to pressurize both ball bearings 7 and 8 (i.e. hold them under pressure against the crankshaft) in order to assure the reliability and reduce the noise of a structure as shown in FIG. 7. In this conventional hermetically sealed compressor of FIG. 7, though ball bearing 8 is pressurized by the deadweight of compression element 2, it is necessary to pressurize ball bearing 7 by additional means which increases the number of parts required.

(c) In this structure, because of the radial clearance required (particularly as bearings wear), it is necessary to provide a space S in view of assembly clearance dimensions between stator 4 and rotor 5. The space S may make compressor operation unstable and also cause a reduction in motor efficiency.

OBJECTS OF THE INVENTION

Accordingly, the principal object of the invention is to provide a hermetically sealed compressor with improved life span and reliability by reducing the load on ball bearings in the operation of the compressor.

Another object of the invention is to stabilize the efficiency of the hermetically sealed compressor by stabilizing the space between rotor and stator.

Further objects and advantages reside in the cooperation of parts of the structure which facilitates the operation and the assembly of the hermetically sealed compressor.

SUMMARY OF THE INVENTION

In carrying out our invention in one preferred mode, there is provided a hermetically sealed compressor comprising an electric element and a compression element resiliently supported within a hermetic container A crankshaft is secured to the rotor of the electric element and is supported by a ball bearing. The crankshaft is comprised of a concentric principal part, a secondary concentric part and an eccentric axial element positioned between the principal part and the secondary part. The eccentric axis fits within one end of a connecting rod of a compressor piston. The ball bearing which supports the crankshaft may be installed in cooperative relation (i.e. in mating contact) with either the principal part or the secondary part of the crankshaft.

In carrying out our invention in another preferred mode, there is provided another structure in which a hermetically sealed compressor, comprising an electric element and a compression element is resiliently supported within hermetic container. In this structure the crankshaft is secured to the rotor of the electric element and is supported by a pair of ball bearings. The crankshaft is comprised of a principal concentric part and an eccentric axial part positioned at the upper end of the crankshaft. The eccentric axial part fits within the one end of the connecting rod of a compressor piston. A first ball bearing is installed in cooperative relation with the principal part of the crankshaft, and a second ball bearing is installed in cooperative relation with the eccentric axial part coaxially with first ball bearing. A spacer, having an eccentric hole, is inserted in an inner washer of the second ball bearing, and the eccentric axial part is inserted in this eccentric hole.

In carrying out our invention in another preferred mode, which also includes a hermetically sealed compressor comprising an electric element and a compression element resiliently supported within hermetic container, a crankshaft is secured to a rotor of the electric element and is also supported by a pair of ball bearings. The crankshaft is comprised of a principal concentric part, secondary concentric part and an eccentric axial part positioned between the principal part and the secondary part. The eccentric axis fits within one end of a connecting rod of a compressor piston. As seen in a projection view along the axis of the concentric principal part, the eccentric axial part covers (i.e. overlays) all of the principal part and the secondary part of the crankshaft. A pair of ball bearings are installed in cooperative relation with both the principal part and the secondary part respectively.

BRIEF DESCRIPTION OF THE DRAWINGS

The structure, organization and operation of the invention will now be described more specifically in the following detailed description with reference to the accompanying drawings, in which.

DETAILED DESCRIPTION OF PREFERRED EMBODIMENTS

Figure 1:
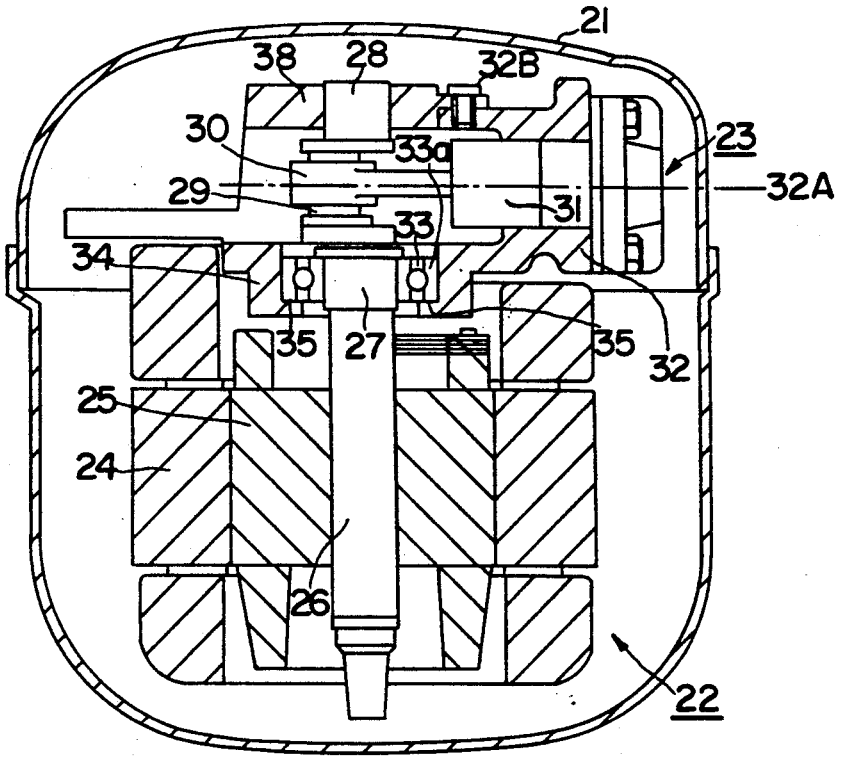
FIG. 1 is a longitudinal cross sectional view, showing the structure of one preferred hermetically sealed compressor according to the present invention.

Referring to the drawings in greater detail, FIG. 1 shows one preferred embodiment of the invention, a hermetically sealed compressor which is particularly adaptable for use with refrigeration apparatus wherein a refrigerant is compressed, condensed and evaporated in a repeated cycle.

The compressor includes a hermetic container 21 which hermetically seals the interior of the compressor and whose surface is unbroken except for inlet and outlet lines and the electrical connector (not shown in FIG. 1). Within the hermetic container 21 are mounted an electric element 22 and a compression element 23. In general, electric element 22 and compression element 23 are resiliently supported within and in spaced relationship with hermetic container 21. The electric element 22 comprises stator 24, rotor 25, and crankshaft 26. The rotor 25 is mounted concentrically within the stator 24 and secured to crankshaft 26, so that after rotor 25 is pressed in place on crankshaft 26, crankshaft 26 and rotor 25 form a single unitary assembly. The crankshaft 26 comprises a principal concentric part 27, a secondary concentric part 28 and an eccentric axial part 29, all of which (27, 28, 29) are integrally formed as a single molding. The principal part 27 and secondary part 28 are coaxial. The eccentric axial part 29 is positioned between principal part 27 and secondary part 28 and eccentric from both principal part 27 and secondary part 28.

The compression element 23 comprises connecting rod 30, piston 31 and cylinder 32. The eccentric axial part 29 fits within one end of connecting rod 30 and the other end of connecting rod 30 is connected to piston 31. Ball bearing 33 is located with electric element 22 on one side of axis 32A of cylinder 32 and pressed in place on principal part 27. A sliding bearing 38 is located on the other side of axis 32A of cylinder 32 (that is the side of axis 32A other than that on which the electric element 22 is located). Secondary part 28 is inserted in sliding bearing 38. An outer washer 33*a* of ball bearing 33 is inserted in housing 34 and the weight of both crankshaft 26 and rotor 25 are supported by contact at face 35 with both housing 34 and outer washer 33*a*. In other words, downward force caused by weight of both crankshaft 26 and rotor 25 are supported at the outer washer 33*a* of the ball bearing 33, and the ball bearing 33 shall be pre-loaded. Housing 34 and cylinder 32 are integrally formed as a single molding. Ball bearing 33 and sliding bearing 38 are provided with a continuing oil supply by an oil pump (not shown in FIG. 1). The reciprocating piston 31 is also lubricated within cylinder 32. Other things are standard and well known in the art and therefore further explanation is omitted. In assembly, first, ball bearing 33 is pressed in place on principal part 27 of crankshaft 26. Then crankshaft 26 is inserted in housing 34. After that, sliding bearing 38 and cylinder 32 are secured by bolt 32B, and later connecting rod 30 which consists of two parts is installed by assembly with eccentric axial part 29. In operation, the compressor is driven by a suitable electrical energy source and piston 31 is reciprocated in cylinder 32 to compress refrigerant gasses.

In this first embodiment, because ball bearing 33 and sliding bearing 38 are arranged on opposite sides of axis 32A (that is one is on the same side of axis 32A as the electric element and the other is on the side of axis 32A of cylinder 32 away from the electric element, respectively), the load caused by reaction to the compression load is equally supported by both ball bearing 33 and sliding bearing 38. Consequently, this reduces the loads on ball bearing 33 and sliding bearing 38 in operation and also improves the life span and reliability of both ball bearing 33 and sliding bearing 38. Also because the dead weight of both crankshaft 26 and rotor 25 are supported at outer washer 33*a* of ball bearing 33, ball bearing 33 is structurally pressurized without additional pressurizing means.

Figure 2:
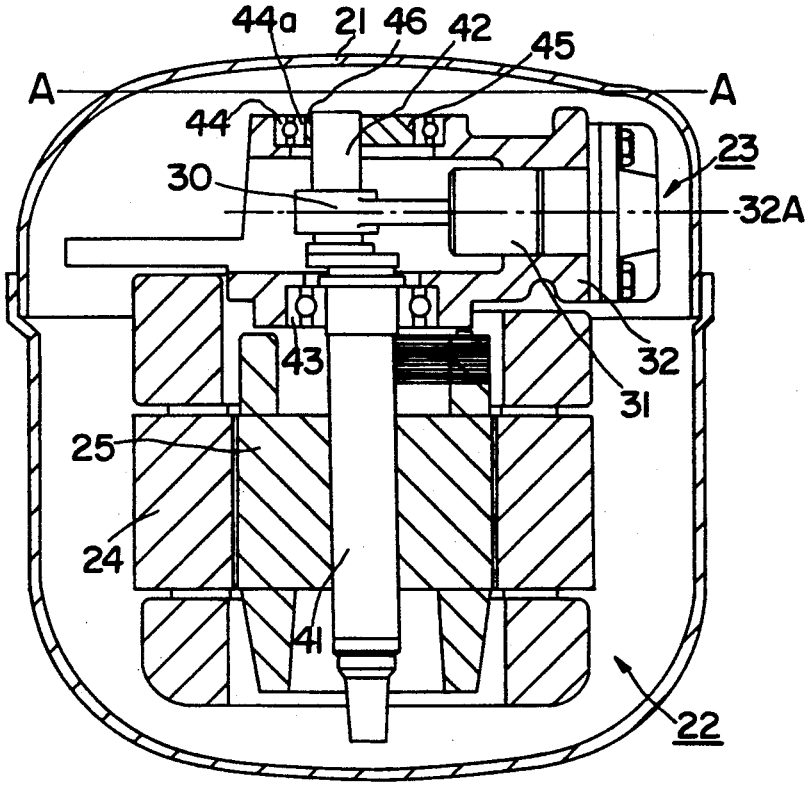
FIG. 2 is a longitudinal cross sectional view, showing the structure of another preferred hermetically sealed compressor according to the present invention.
Figure 3:
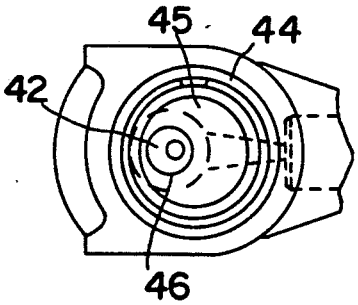
FIG. 3 is a fragmentary plan view of the hermetically sealed compressor of FIG. 2 taken in the plane A—A of FIG. 2.

FIGS. 2 and 3 show another preferred embodiment of the invention, which has significant differences from the first embodiment previously described. At its upper end, crankshaft 41 carries an eccentric axial part 42 which is eccentric from crankshaft 41. Both crankshaft 41 and eccentric axial part 42 are integrally formed as a single molding. Eccentric axial part 42 fits within one end of connecting rod 30 and the other end of connecting rod 30 is connected to piston 31. Ball bearing 43 is located on the electric element (22) side of axis 32A of cylinder 32 and pressed in place on crankshaft 41. Another ball bearing 44 is located on the other side (i.e. the side away from electric element 22) of axis 32A of cylinder 32 and installed coaxially with ball bearing 43. A spacer 45, having a hole 46, is pressed in place on inner washer 44a of ball bearing 44. The hole 46 is eccentric from the axis of ball bearing 44 and the eccentric location, or radial offset, of hole 46 corresponds to the radial distance between the axis of crankshaft 41 and the axis of eccentric axial part 42. Eccentric axial part 42 is inserted in hole 46 of spacer 45. In assembly, first, ball bearing 43 is pressed in place on crankshaft 41. Then spacer 45 is pressed in place on inner washer 44a of ball bearing 44. After that, eccentric axial part 42 is inserted in one end of connecting rod 30 and later eccentric axial part 42 is inserted in hole 46 of spacer 45.

In this second embodiment, as in the first embodiment described above, the load caused by the reaction of the compression load are equally supported by both ball bearings 43 and 44. This consequently improves the life span and reliability of both ball bearings 43 and 44. Also, the longer distance between ball bearings 43 and 44, in comparison with the conventional example described above, reduces the required clearance dimension between rotor 25 and stator 24. This in turn leads to stabilization and better motor efficiency. And also, because there is no need of a secondary axial part, as shown in FIG. 1, assembly of the device is facilitated in that processing is easier and it is not necessary to divide connecting rod 30 for assembly.

Figure 4:
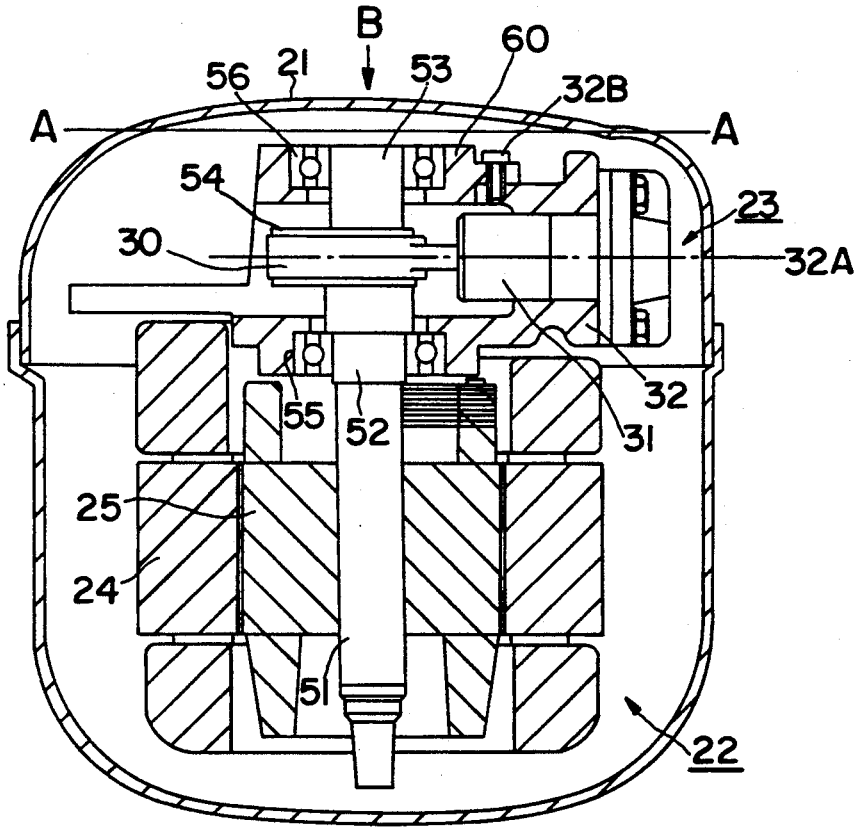
FIG. 4 is a longitudinal cross sectional view, showing the structure of still another preferred hermetically sealed compressor according to the present invention.
Figure 5:
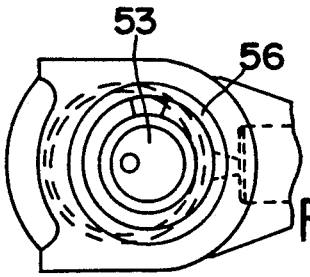
FIG. 5 is a fragmentary plan view of the hermetically sealed compressor of FIG. 4 taken in the plane A—A of FIG. 4.
Figure 6:
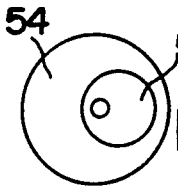
FIG. 6 is a plan view of the crankshaft of the hermetically sealed compressor illustrated in FIG. 4 in a direction downwardly from the top of the compressor, that is, as shown by arrow B in FIG. 4.
Figure 7:
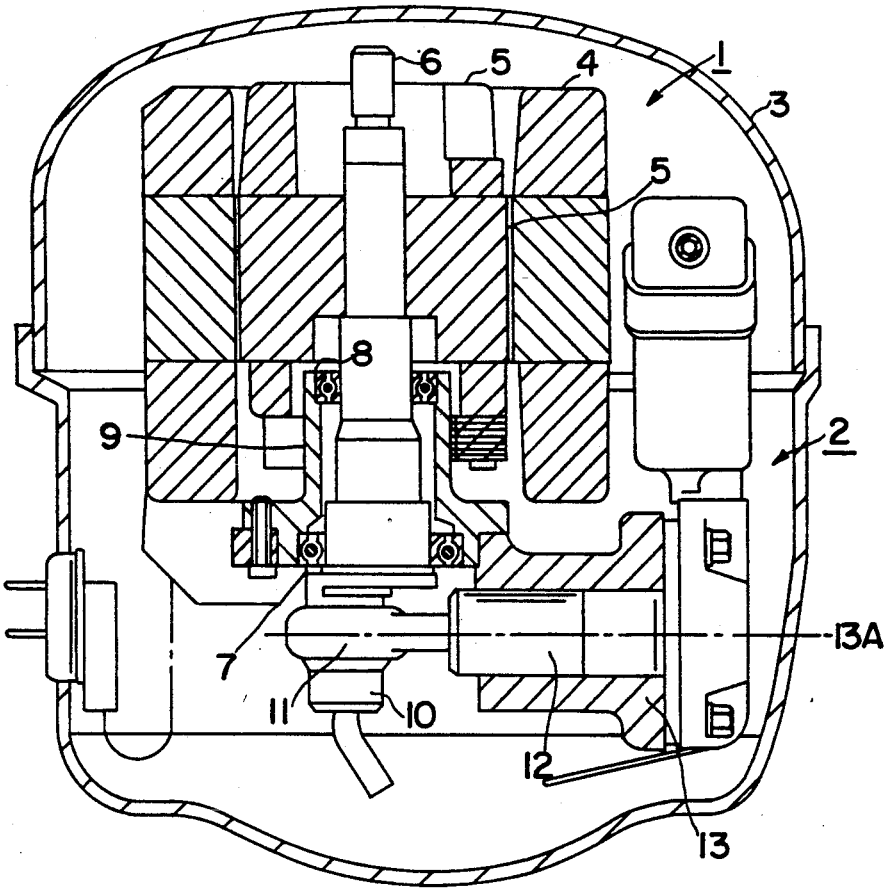
FIG. 7 PRIOR ART
FIG. 7 is a longitudinal cross sectional view, showing the structure of a conventional hermetically sealed compressor.
Figure 8:
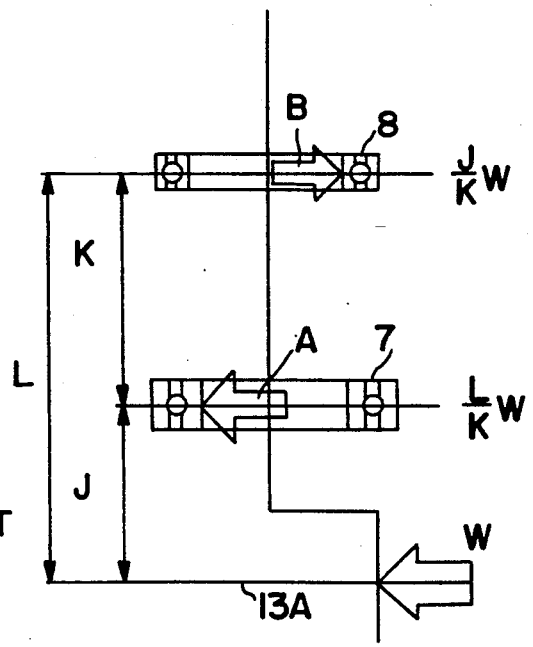
FIG. 8 PRIOR ART
FIG. 8 is a schematic force diagram of the ball bearing of the conventional hermetically sealed compressor illustrated in FIG. 7 in operation.

FIGS. 4, 5 and 6 show still another preferred embodiment of the invention which has significant differences from the first and second embodiments previously described. In this embodiment, crankshaft 51 comprises principal part 52, secondary part 53 and eccentric axial part 54. Part 54 is positioned between principal part 52 and secondary part 53. All of them (52, 53, 54) are integrally formed as a single molding. Ball bearing 55 is positioned on the electric element (22), side of axis 32A of cylinder 32, and pressed in place on principal part 52. Another ball bearing 56 is located on the other side of axis 32A of cylinder 32 and pressed in place on secondary part 53. Eccentric axial part 54 fits within one end of connecting rod 30 and the other end of connecting rod 30 is connected to piston 31.

In this embodiment, eccentric axial part 54 covers or overlays all of principal part 52 and secondary part 53, when seen in projection or plan view. This is best seen in a projection view from the axis direction of crankshaft 51 as indicated in FIG. 6. In assembly, first, piston 31 with connecting rod 30 is inserted in cylinder 32. Then crankshaft 51 is inserted in one end of connecting rod 30. After that, block 60 and cylinder 32 are secured by bolt 32B and later, ball bearings 55 and 56 are pressed in place on both principal part 52 and secondary part 53.

As in the other embodiments discussed above, in this third embodiment, which is also similar to the first embodiment in certain respects, a load caused by the reaction of the compression load is equally supported by both ball bearings 55 and 56. This consequently improves the life span and reliability of both ball bearings 55 and 56. In comparison with the conventional design described above, the improved bearing life reduces the increase in clearance between rotor 25 and stator 24, which otherwise develops as bearings wear. This leads to stabilization of motor efficiency. Further, because there is no need of a secondary axis, processing is easier and dividing connecting rod 30 for assembly is unnecessary. As can be seen, this invention improves the life span and reliability of a ball bearing by reducing the load on the ball bearing in operation, and also stabilizes the efficiency of the hermetically sealed compressor by stabilizing the space between rotor and stator. In this embodiment of the invention also, processing and assembly of the hermetically sealed compressor is facilitated.

It should be understood that various other modifications of the present invention will be apparent to and can be readily made by those skilled in the art without departing from the scope and spirit of this invention. Accordingly, it is not intended that the scope of the claims appended hereto be limited to the description as set forth herein, but rather that the claims be construed as encompassing all the features of patentable novelty that reside in the present invention, including all features that would be treated as equivalents thereof by those skilled in the art to which this invention pertains.

What is claimed is:

1. A hermetically sealed compressor, comprising:
an electric element having a rotor and a crankshaft, said crankshaft being arranged vertically;
a compression element for compressing gas said element having a connecting rod operatively connected to said crankshaft; and
a hermetic container resiliently supporting said electric element and compression elements therein;
said crankshaft being secured to said rotor of the electric element and supported by a ball bearing, wherein said ball bearing includes an outer washer;
said crankshaft comprising a principal part, a secondary part and an eccentric axial part, positioned between the principal part and the secondary part,
said eccentric axial part being connected to one end of said connecting rod, said ball bearing being installed in at least one of said principal part and secondary part so that downward force caused by weight of both said crankshaft and said rotor are supported at the outer washer of said ball bearing in order to preload said ball bearing.

2. A hermetically sealed compressor comprising:
an electric element having a rotor and a crankshaft; and
a compression element having a connecting rod; and
a hermetic container resiliently supporting said electric element and compression element therein;
said crankshaft secured to said rotor of the electric element and supported by a pair of ball bearings,
said crankshaft comprising a principal part and an eccentric axial part, positioned at its upper end,
said eccentric axial part being connected to one end of said connecting rod,
a first one of said ball bearings being installed in mating contact with said principal part of said crankshaft,
a second one of said ball bearings being installed in mating contact with said eccentric axial part coaxially with said first one of said ball bearings,
a spacer, having an eccentric hole, inserted in an inner washer of said second one of said ball bearings,
said eccentric axial part of said crankshaft inserted in said eccentric hole of the spacer.

3. A hermetically sealed compressor comprising:
an electric element having a rotor and a crankshaft, said crankshaft being arranged vertically;
a compression element having a connecting rod; and a hermetic container for containing and resiliently supporting said electric element and compression element;

said crankshaft secured to said rotor of the electric element and supported by a pair of ball bearings, each of said ball bearings including an outer washer, said crankshaft comprising a principal part, a secondary part, and an eccentric axial part, said eccentric axial part positioned between the principal part and the secondary part, said eccentric axial part being connected to one end of said connecting rod, said eccentric axial having a shape which in a projection view in the axial direction of said crankshaft overlays all of said principal part and said secondary part of said crankshaft, one of said pair of ball bearings being installed in each of said principal part and said secondary part respectively, and the outer washer of at least one of said ball bearings being installed so that downward force caused by weight of both said crankshaft and said rotor are supported at least one of said outer washer of said ball bearing in order for said ball bearing to be pre-loaded.

4. A hermetically sealed compressor, as recited in claim 1, including two bearings supporting said crankshaft and disposed along the length of said crankshaft with one of said bearings on one side of said eccentric part of said crankshaft and the other bearing on the other side of said crankshaft.

5. A hermetically sealed compressor according to claim 1, said compressor further including a cylinder mass in which said compression element moves, wherein said cylinder mass remains substantially stationary relative to said hermetic container.

6. A hermetically sealed compressor according to claim 3, said compressor further including a cylinder mass in which said compression element moves, wherein said cylinder mass remains substantially stationary relative to said hermetic container.

* * * * *